US005136958A

United States Patent [19]

Nakano et al.

[11] Patent Number: 5,136,958

[45] Date of Patent: Aug. 11, 1992

[54] THREAD CHAIN FORMED BY AN OVERLOCKING SEWING MACHINE AND A METHOD FOR MAKING THE THREAD CHAIN

[75] Inventors: Minoru Nakano; Toru Yamazaki, both of Osaka, Japan

[73] Assignee: Pegasus Sewing Machine Mfg. Co., Ltd., Osaka, Japan

[21] Appl. No.: 729,759

[22] Filed: Jul. 15, 1991

Related U.S. Application Data

[62] Division of Ser. No. 386,082, Jul. 26, 1989, Pat. No. 5,056,446.

[30] Foreign Application Priority Data

Jul. 27, 1988 [JP] Japan ..... 63-178838
Jul. 27, 1988 [JP] Japan ..... 63-187839

[51] Int. Cl.[5] ..... D05B 1/20; D05B 93/00

[52] U.S. Cl. ..... 112/269.1; 112/162; 112/438

[58] Field of Search ..... 112/438, 162, 268.1, 112/269.1, 433, 436, 425, 441, 197, 199, 165, 166, 254, 255

[56] References Cited

U.S. PATENT DOCUMENTS 3,009,430 11/1961 Lutz et al. ..... 112/162
4,117,792 10/1978 Navlyt ..... 112/269.1 X
4,254,723 3/1981 Rothstein ..... 112/255
4,300,464 11/1981 Bonalumi ..... 112/254
4,373,460 2/1983 Parker et al. ..... 112/162
4,408,554 10/1983 Takiguchi et al. ..... 112/302
4,452,156 6/1984 Teetz et al. ..... 112/255 X
4,512,274 4/1985 Campbell, Jr. et al. ..... 112/438 X
4,566,396 1/1986 Sakuma et al. ..... 112/302
4,590,879 5/1986 Matsubara et al. ..... 112/278
4,632,048 12/1986 Matsubara ..... 112/262.1
4,649,844 3/1987 Matsubara ..... 112/278 X
4,682,554 7/1987 Goto et al. ..... 112/262.1
4,726,308 2/1988 Aida et al. ..... 112/254
4,766,827 8/1988 Matsubara ..... 112/278
4,793,273 12/1988 Hara et al. ..... 112/254
4,869,186 9/1989 Ogawa ..... 112/255
4,873,931 10/1989 Takagi et al. ..... 112/121.11

*Primary Examiner*—Peter Nerbun
*Attorney, Agent, or Firm*—Armstrong & Kubovcik

[57] ABSTRACT

An automatic thread supply device for a conventional overlocking sewing machine is disclosed. Each of a needle thread, an upper looper thread and a lower looper thread is supplied to a thread supply roller but the supply is stopped for an optimum period by a thread holder, whereby the supply length of each thread is adjusted. In forming a thread chain, the total supply length of the looper threads is not more than five times of the length of the needle thread, and the smallest length of the above threads is not more than half of the total length of the remaining threads. In this way, a highly expandable thread chain is formed having a good appearance.

2 Claims, 11 Drawing Sheets

| Stitch type | Needle thread | Upper looper thread | Lower looper thread | |
|---|---|---|---|---|
| 504 | 1 | 4 | 4 | ← Supply length for sewing |
| | 1 | 3 | 2 | ← Supply length for forming a thread chain |
| 505 | 2.5 | 4 | 2.5 | ← Supply length for sewing |
| | 2.5 | 4 | 2.5 | ← Supply length for forming a thread chain |
| ⋮ | | | | |

Fig. 11

| Stitch type | Needle thread | Upper looper thread | Lower looper thread | |
|---|---|---|---|---|
| 504 | 1 | 4 | 4 | ← Supply length for sewing |
| | 1 | 3 | 2 | ← Supply length for forming a thread chain |
| 505 | 2.5 | 4 | 2.5 | ← Supply length for sewing |
| | 2.5 | 4 | 2.5 | ← Supply length for forming a thread chain |
| ------ | | | | |

THREAD CHAIN FORMED BY AN OVERLOCKING SEWING MACHINE AND A METHOD FOR MAKING THE THREAD CHAIN

This is a divisional application of application Ser. No. 386,082 filed Jul. 26, 1989 now U.S. Pat No. 5,056,446.

BACKGROUND OF THE INVENTION (1) Field of the Invention

This invention relates to an automatic thread supply device for an overlocking sewing machine, to a thread chain which is formed by the overlocking sewing machine when there is no fabric at the sewing area of the overlocking sewing machine, and to a method of forming such a thread chain.

(2) Description of the Prior Art

In the overlocking sewing machine disclosed in U.S. Pat. No. 3,145,672 or the like, a thread chain is formed of entangled needle and looper threads immediately after the rear end of a fabric passes the needle drop point. As disclosed in U.S.Pat. No. 3,123,033, such a thread chain is cut off by a cutter provided in the overlocking sewing machine so that the thread chain extended from the needle drop point has a predetermined length. This thread chain is held and sewn in on the back surface of the leading end of the following fabric.

If the thread chain is expandable, it can be stretched out and sewn in within a stitch width W along a side of a fabric M (FIG. 1*a*). If it is not expandable, some parts of it shown with T1 and T2 come out of the leading end of the fabric M and the stitch width W (FIG. 1*b*), resulting in poor appearance.

In order to form an expandable, that is high quality, thread chain, each supply length per stitch of the needle thread and the looper threads should be adjusted. In a conventional overlocking sewing machine, spring pressure of each thread tension regulator is adjusted, namely the tension of each thread is adjusted, when a thread chain is formed. According to this method, however, the supply length ratio of the threads cannot be adjusted accurately enough to form a high quality thread chain.

SUMMARY OF THE INVENTION

Accordingly, a primary object of this invention is to provide an automatic thread supply device which forms an expandable thread chain.

Another object of this invention is to provide a thread chain which is expandable enough to sew in within a sewing width of a fabric.

Still another object of this invention is to provide a streamlined method of forming a thread chain.

The above objects are fulfilled by an automatic thread supply device for an overlocking sewing machine having a main shaft, thread sources and a sewing area where a stitch or thread chain is formed during one sewing cycle according to the rotation of the main shaft, the automatic thread supply device comprising the same number of thread supply rollers that of the thread sources consisting of a needle thread and a plurality of looper threads. Each of the rollers is rotated at a certain speed independently from the main shaft. A pressing device presses the threads onto the thread supply rollers in order to pull out the threads from the thread sources. A thread supply stopping device holding the threads in order to stop the threads from being supplied to the thread supply rollers. The thread supply stopping device is between the thread supply rollers and the thread sources. A device detects whether there is any fabric at the sewing area or not. A control device controls the thread supply stopping device to hold the threads for optimum periods during the one sewing cycle in order that the thread supply rollers supply the threads at a predetermined length ratio to the sewing area according to the detection of the detecting device.

The detecting means is not necessary in the following cases: 1) the length of the fabric is determined; and 2) the operator visually checks when the fabric passes the needle drop point and operates the foot pedal or the like. In the case of 1), the stitch counter starts counts when the needle starts sewing the fabric. When the counter reaches the predetermined value, it is determined that the fabric passes the needle drop point, and that determination is conveyed to the controlling device. In the case of 2), a switch is turned on when the pedal or the like is operated, and the ON signal is sent to the controlling device.

According to this invention, thread tension is not adjusted by a thread tension regulator, but a thread is forcibly supplied by a thread supply roller and a pressing device. Therefore, the supply length of each thread is accurately controlled. When there is no fabric at the needle drop point, the thread holding period of each thread supply stopping device is controlled to adjust the supply length of each thread, whereby a high quality thread chain is formed. The thread chain formed according to this invention can be stretched out as shown in FIG. 1*a* and sewn in along a side of the fabric, and the obtained product has an excellent appearance.

The above objects are also fulfilled by a thread chain formed by an overlocking sewing machine when there is no fabric at a needle drop point of the overlocking sewing machine; the thread chain being made of two looper threads and at least one needle thread, wherein the total length of the looper threads is not more than five times of the length of the needle thread and wherein the smallest length of the above threads is not more than half of the total length of the remaining threads.

The above objects are also fulfilled by a method for making a thread chain, formed by an overlocking sewing machine when there is no fabric at a needle drop point of the overlocking sewing machine, wherein the total length of the looper threads is not more than five times of the length of the needle thread and wherein the smallest length of the above threads is not more than half of the total length of the remaining threads.

In the above construction, the supply length ratio of the needle and looper threads is restricted within a specified range. Therefore, a high quality thread chain can be obtained, resulting in a product of good appearance with no thread extrusion from the leading end of the fabric or from the stitch width.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

FIG. 11 is a memory map in a RAM.

DETAILED DESCRIPTION OF AN EMBODIMENT

Figure 1A:
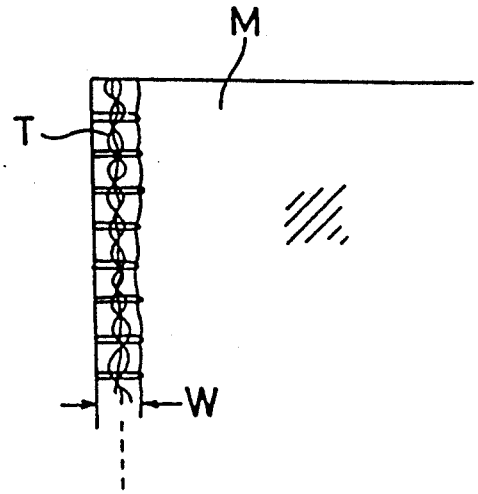
FIG. 1*a* is a plan view showing an example of sewing using a high quality thread chain.
Figure 1B:
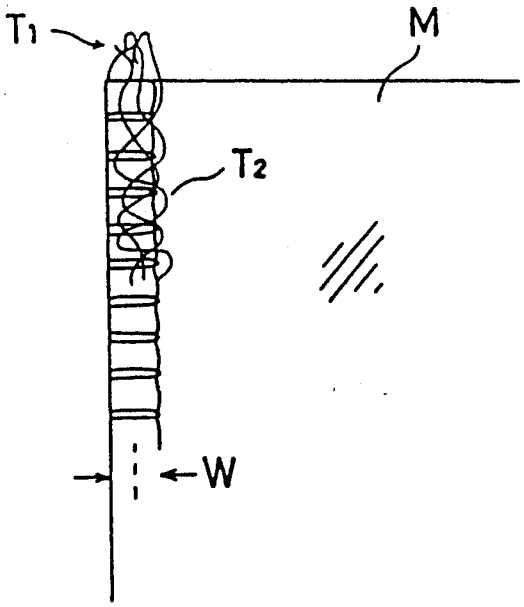
FIG. 1*b* is a plan view showing an example of sewing using a poor thread chain.
Figure 2:
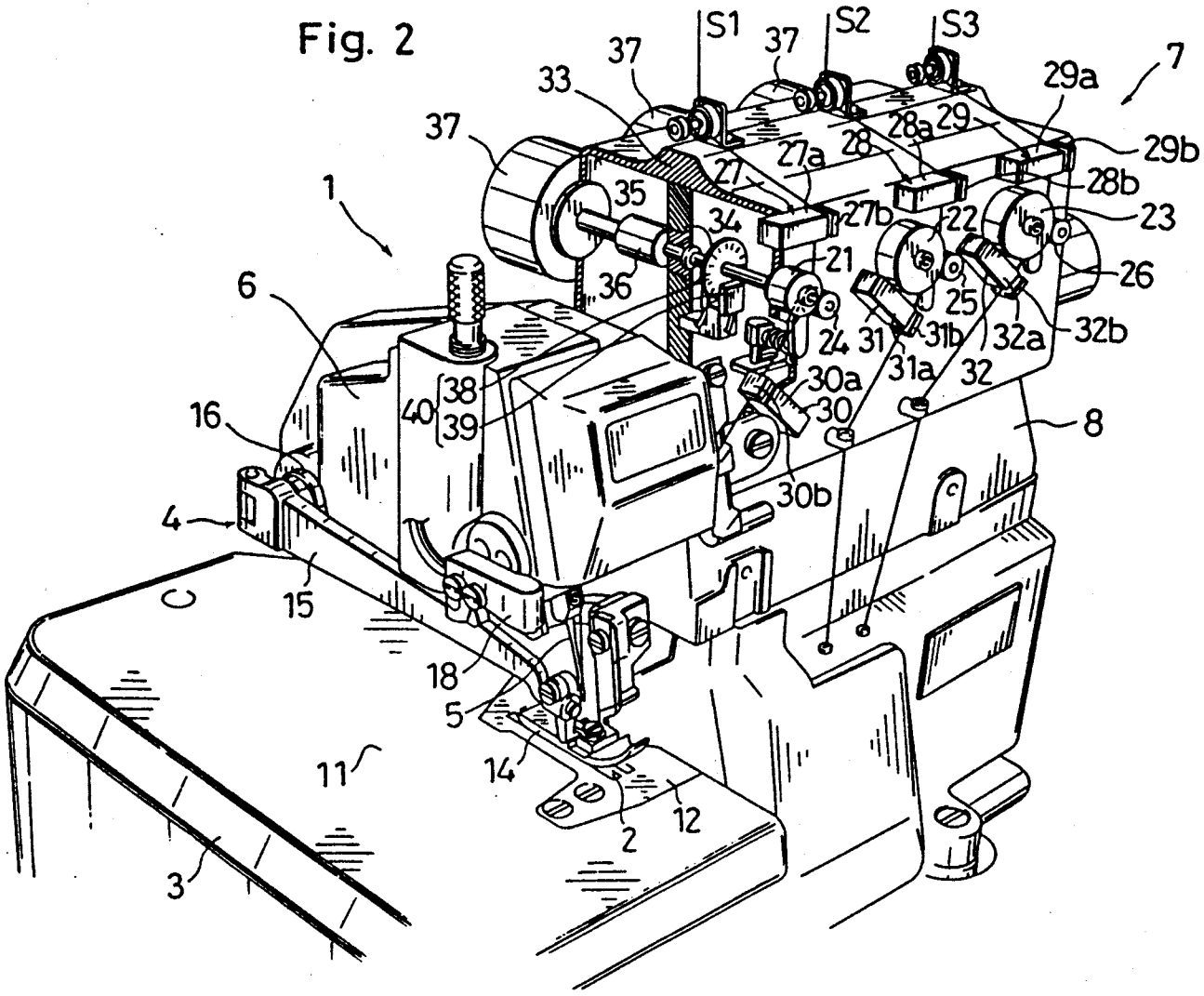
FIG. 2 is a perspective view of an automatic thread supply device for an overlocking sewing machine according to this invention.

FIG. 2 illustrates an automatic thread supply device 7 according to this invention mounted on a well-known overlocking sewing machine 1. The thread supply device 7 individually controls the supply lengths per stitch of threads S1, S2 and S3 loaded for the needle 5 and loopers (not shown). The overlocking sewing machine 1 comprises a transport section 2 on which a fabric is to be transported at a predetermined pitch, a fabric table 3, a pressing section 4 for pressing the fabric toward the fabric table 3 with a predetermined force, an arm 6 equipped with a sewing needle 5, and a main body 8.

The fabric table 3 provided to the left (seen from the operator) of the main body 8 has a plane plate 11 thereon, on which the fabric is to be placed. The plate 11 has a needle plate 12 around the transport section 2. Feed dogs (not shown) are designed to come up above the the needle plate 12 at a predetermined pitch in accordance with the vertical movement of the needle 5, whereby transporting the fabric.

The pressing section 4 has a pressing bar 15, which is substantially in parallel with the cloth plate 11. The pressing bar 15 has a presser foot 14 at its end closer to the operator. The fabric is interposed between the presser foot 14 and the needle plate 12. The pressing bar 15 is separated from the needle plate 12 by a driving section 16 when there is no necessity for pressing the fabric.

On the left side (seen from the operator) of the arm 6 is a detecting sensor 18 for optically detecting if the fabric exists at the needle drop point of the needle plate 12. A well-known needle positioner (not shown), for detecting where the needle 5 is between its top dead point and its bottom dead point, is provided on a main shaft (not shown) of the main body 8.

The thread supply device 7 comprises a needle thread supply roller 21, an upper looper thread supply roller 22, a lower looper thread supply roller 23, pressing rollers 24 through 26, and thread holders 27 through 32 provided before and after the thread supply rollers 21, 22 and 23 in the thread transporting direction.

Figure 3:
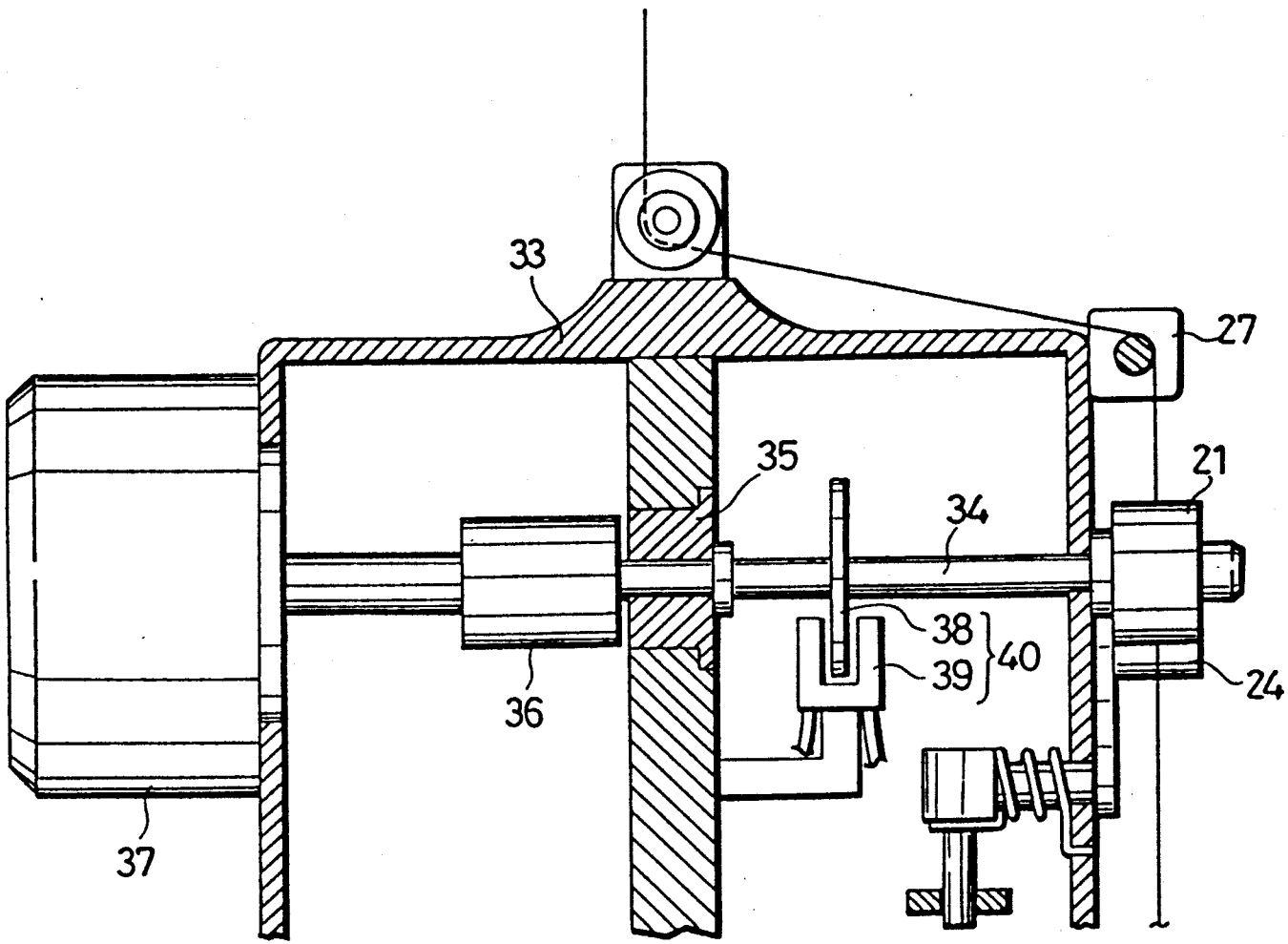
FIG. 3 is a sectional view showing a thread supply roller drive mechanism.

The construction of the vicinity of the thread supply rollers 21, 22 and 23 is exemplified in FIG. 3, using 21. The thread supply roller 21 is inserted through by a rotating axis 34, which passes through a casing 33 mounted on the main body 8. The rotating axis 34 is rotatably supported by a bearing 35 and is connected to a motor 37 through a coupling 36.

The motor 37 is constantly rotated at a predetermined speed independently from the main shaft of the overlocking sewing machine 1. The rotating speed of the motor 37 is controlled to be appropriate to supply the required length of thread when the main shaft is rotated at its maximum speed. The rotating speed of the motor 37 is detected by a pulse encoder 40, which comprises a disc 38 having slits and surrounding the rotating axis 34 and an optical detector 39 provided on the casing 33. Although a motor 37 is provided for each thread supply roller in this embodiment, it is also possible to divide the power of only one motor into three for driving three thread supply rollers.

Figure 4:
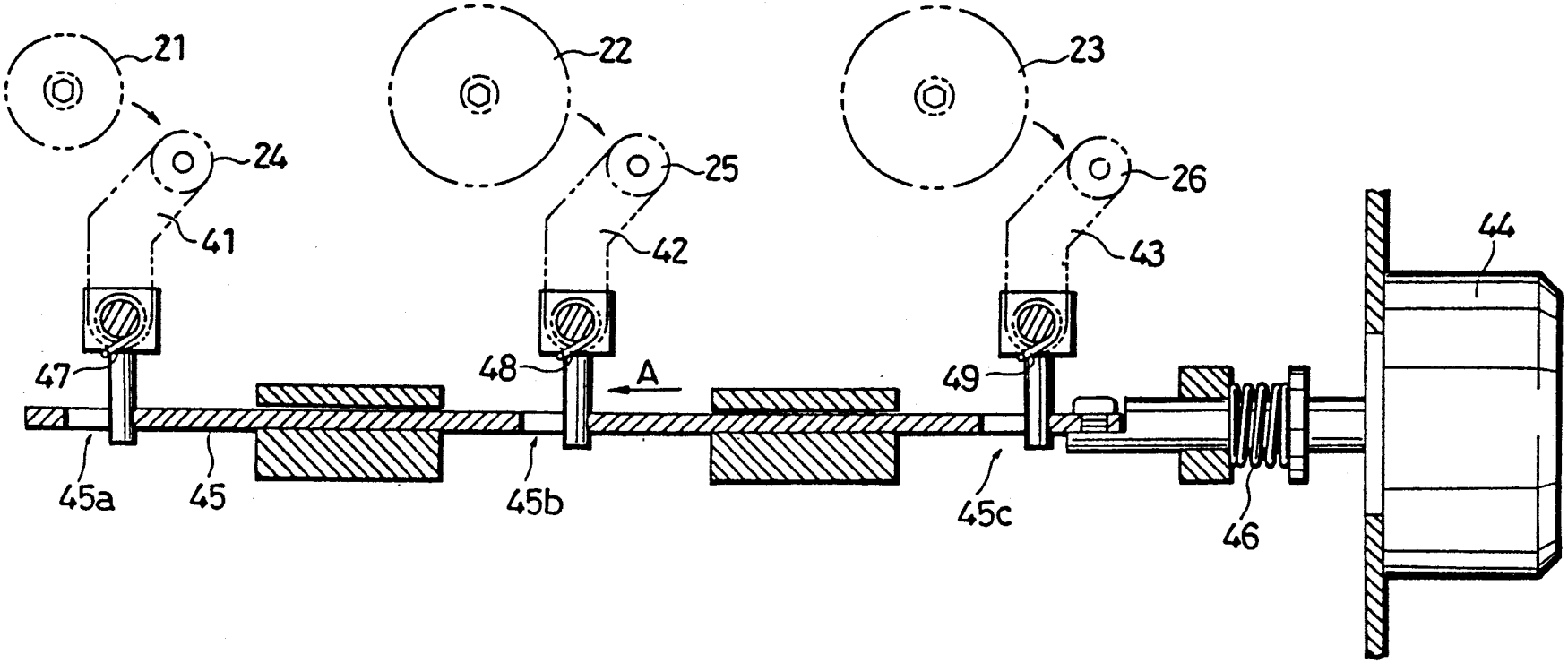
FIG. 4 is a sectional, partially schematic representation showing a pressing roller drive mechanism.

As shown in FIG. 4, pressing rollers 24, 25 and 26 are rotatably provided at the upper ends of pivotal levers 41, 42 and 43 respectively, which are rotatably supported on the casing 33. The lower ends of the pivotal levers 41, 42 and 43 are inserted through holes 45*a*, 45*b* and 45*c* of a sliding plate 45, which is slided by a solenoid 44. When the overlocking sewing machine 1 stops at power on, the solenoid 44 is electrified, whereby the sliding plate 45 is slided in the direction of an arrow A. Then, the pivotal levers 41 through 43 are pivoted a predetermined angle, whereby the pressing rollers 24 through 26 are separated from the thread supply rollers 21 through 23. When the solenoid 44 is de-electrified, the sliding plate 45 is moved back to its original position by a coil spring 46 wound around the axis of the solenoid 44. Then, the pressing rollers 24 through 26 are pressure-contacted on the thread supply rollers 21 through 23 by coil springs 47 through 49, respectively. The pressure-contacting force should be big enough for conveying the transporting force of the thread supply rollers 21 through 23 to the threads S1 through S3 when these threads are interposed between the thread supply rollers 21 through 23 and the pressing rollers 24 through 26. The pressure-contacting force should also be small enough for the above threads to slip on the peripheral surfaces of the thread supply rollers 21 through 23 without being cut off when these threads are held by the thread holders 27 through 29 (FIG. 2).

The thread holders 27 through 32 respectively comprise rectangular parallelopiped solenoids 27*a* through 32*a* and rectangular plates 27*b* through 32*b* attached on one ends of the above solenoids. When the solenoids 27*a* through 32*a* are electrified, the rectangular plates 27*b* through 32*b* approach the solenoids 27*a* through 32*a* respectively, whereby each pair of the plates and the solenoids interpose the thread therebetween. The thread holders 27 and 30 hold the needle thread S1. The thread holders 28 and 31 hold the upper looper thread S2. The thread holders 29 and 32 hold the lower looper thread S3. The holding force of each thread holder is much bigger than the thread transporting force of their respective thread supply rollers. The thread holders 27 through 29, which are provided before the thread supply rollers 21 through 23 in the thread transporting direction, control the supply lengths of the threads. The other thread holders 30 through 32, which are provided after the thread supply rollers 21 through 23 in the thread transporting direction, prevent the threads from being supplied excessively by the thread tension.

Each of the thread holders 27 through 29 holds the thread for a predetermined period. The period is controlled so that any length of thread up to the maximum consumption length of the overlocking sewing machine 1 during each sewing cycle can be supplied. Each of the thread holders 30 through 32 holds the thread only while an unnecessary length of thread would be pulled out by the thread tension generated in the sewing are of the overlocking sewing machine 1 during an opening period of the thread holders 27 through 29. (The above opening period means the period when the thread holders 27 through 29 are not holding the thread.)

Figure 5:
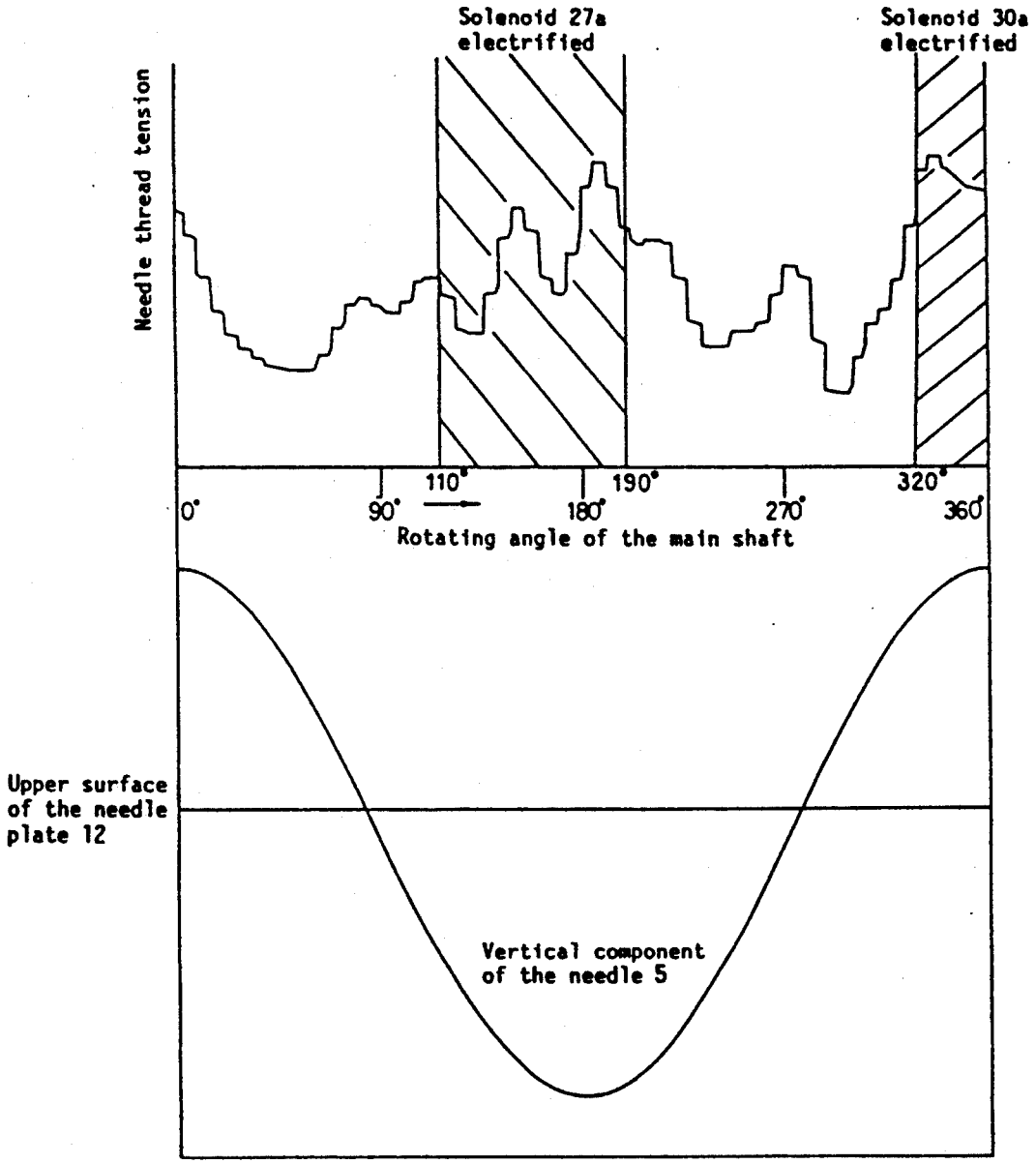
FIGS. 5 through 7 are motion and thread tension diagrams showing the holding periods of a thread supply stopping means.
Figure 6:
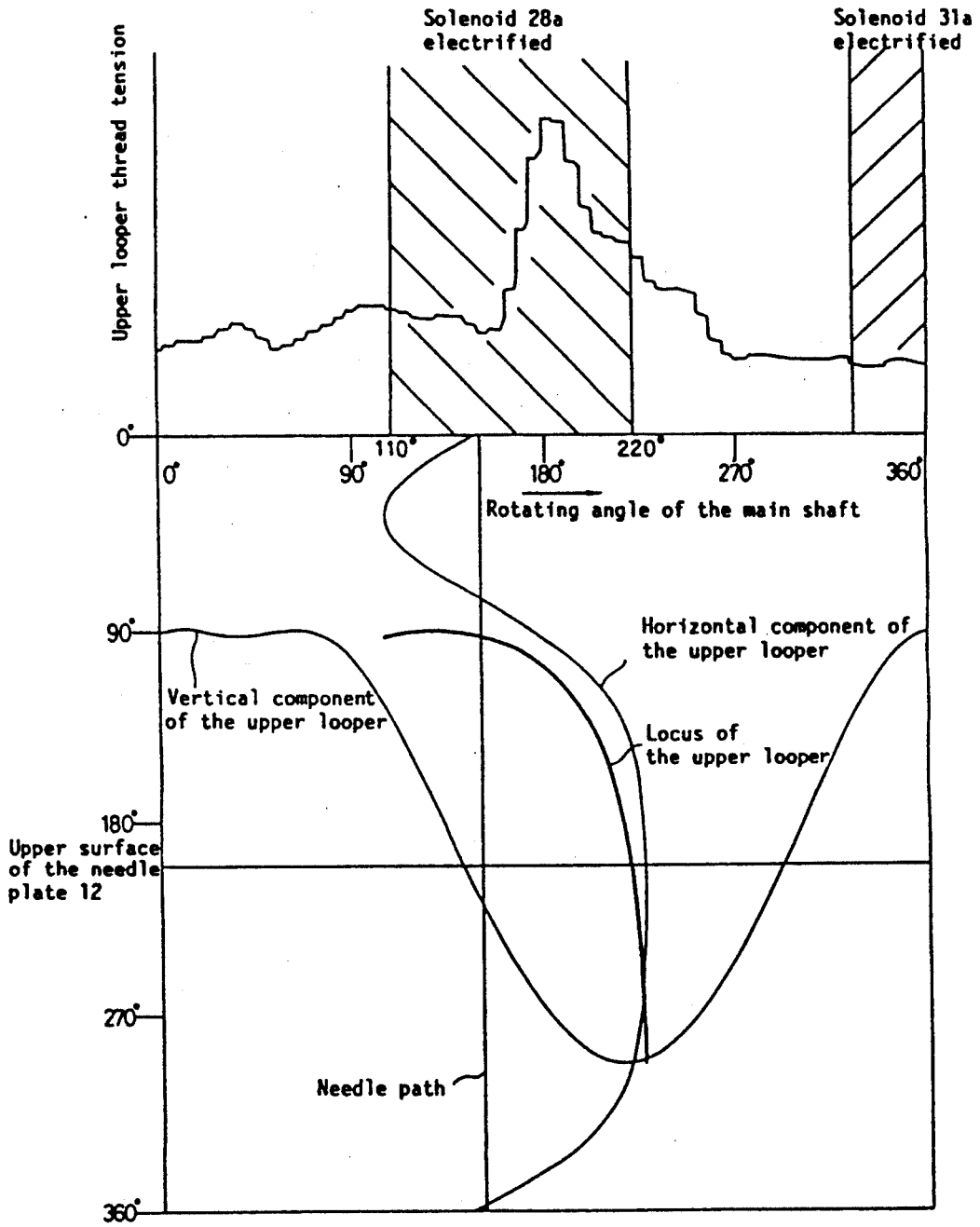

FIG. 5 exemplifies the minimum holding period of the thread holder 27 for supplying the maximum consumption length of thread of the overlocking sewing machine 1 and the holding period of the thread holder 30. FIG. 6 exemplifies the above holding periods of the thread holders 28 and 31, and FIG. 7 exemplifies the above holding periods of the thread holders 29 and 32. Also shown in these figures are the fluctuation of the thread tension and the motion diagram of the needle and the upper and lower loopers. The holding periods has been controlled on the basis of the above fluctuation and the motion diagram. The thread tension in each figure was measured in a conventional overlocking sewing machine which adjusts the thread tension by a thread tension regulator. The axis of abscissa indicates the rotating angle of the main shaft. 360° of the axis of abscissa corresponds to one sewing cycle.

The thread holder 27 holds the thread when the rotating angle of the main shaft is 110° to 190°, the thread holder 28 when the above angle is 110° to 220°, and the thread holder 29 when the above angle is 80° to 220°. As apparent from FIGS. 5 through 7, each of the above holding periods is substantially the same as the period when the thread tension would be big enough to supply the thread excessively. In the above-mentioned conventional overlocking sewing machine, the thread is forcibly pulled out while the thread tension is so big. However, the thread is not pulled out at all in this embodiment.

Instead, the length of thread corresponding to the maximum consumption of the overlocking sewing machine 1 per stitch is supplied by the thread supply roller and the pressing roller when the thread is not held by the thread holder. The period when the above length of thread is supplied is as follows, where the maximum sewing speed of the overlocking sewing machine 1 is 6000 spm and that the maximum length of the thread consumption per stitch is 16 mm:

(Needle thread)

$$\frac{60\text{ sec}}{6000\text{ spm}} \times \frac{280°}{360°} \approx 7.8\text{ msec}$$

(Upper looper thread)

$$\frac{60\text{ sec}}{6000\text{ spm}} \times \frac{250°}{360°} \approx 7\text{ msec}$$

(Lower looper thread)

$$\frac{60\text{ sec}}{6000\text{ spm}} \times \frac{220°}{360°} \approx 6\text{ msec}$$

Practically, the length of thread to be supplied is smaller than 16 mm and so the period when the thread is supplied is shorter than the above. The thread supply length in the actual sewing depends on the thickness of the fabric and the kind of sewing. For example, the opening period of the Federal Standard stitch type 504 is as follows, where the needle requires 2 mm of thread per stitch and the supply length ratio of needle thread: upper looper thread: lower looper thread is 1:4:4:

(Thread holder 27)

$$\text{approx. 7.8 msec} \times \frac{2\text{ mm}}{16\text{ mm}} = \text{approx. 1 msec}$$

(Thread holder 28)

$$\text{approx. 7 msec} \times \frac{8\text{ mm}}{16\text{ mm}} = \text{approx. 3.5 msec}$$

(Thread holder 29)

$$\text{approx. 6 msec} \times \frac{8\text{ mm}}{16\text{ mm}} = \text{approx. 3 msec}$$

Figure 7:
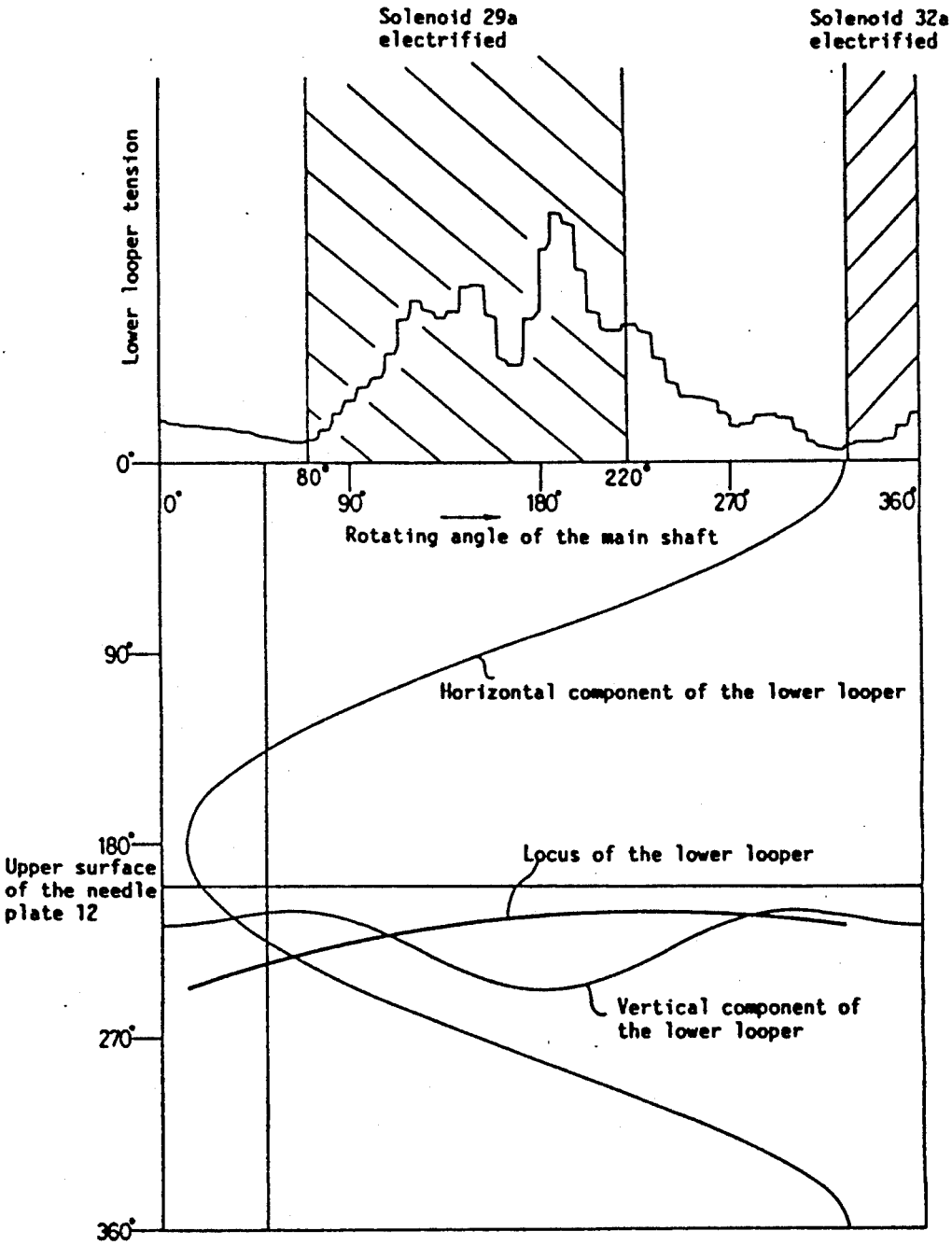

As apparent from FIGS. 5 through 7, the thread holders 30 through 32 hold the threads while the rotating angle of the main shaft is 320° to 360°. Since the tension of only the needle thread is increased during this period, the thread holders 31 and 32 need not hold the threads.

The thread holders 27 through 29 hold the threads once for each sewing cycle not only while the fabric is at the needle drop point but also for a while after the rear end of the fabric passes the needle drop point. For a while after the rear end of the fabric passes the needle drop point, however, the opening periods of the thread holders 27 through 29 should be adjusted so that the threads are supplied at a predetermined ratio in order to obtain a high quality thread chain.

Figure 8A:
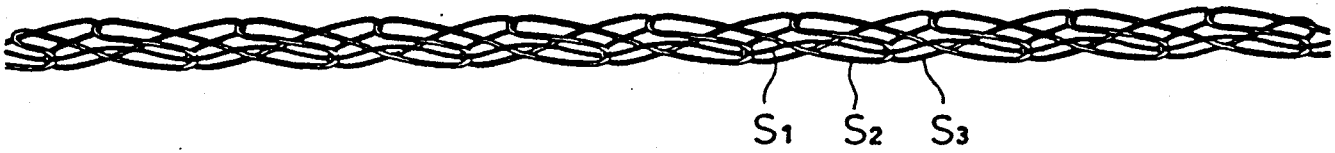
FIG. 8*a* is a schematic illustration showing a thread chain according to this invention.
Figure 8B:
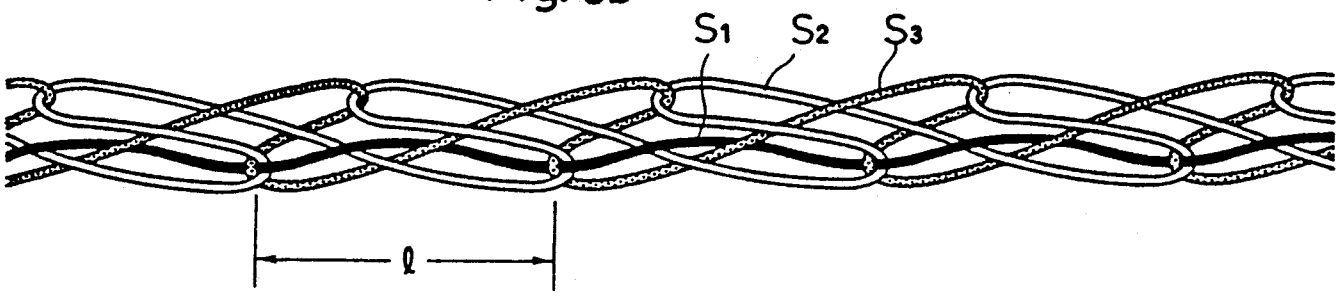
FIG. 8*b* is an enlarged schematic illustration of the same.
Figure 9:
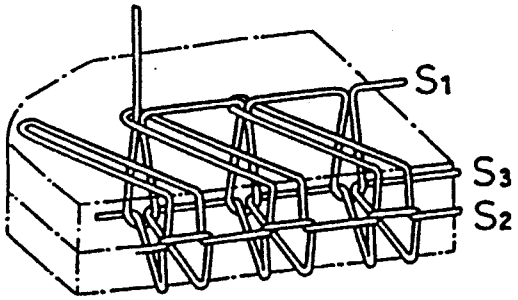
FIG. 9 is a schematic illustration showing the Federal Standard stitch type 504.

The supply length ratio of the threads will be described below. FIG. 8*a* shows a desirable thread chain, and FIG. 8*b* is its enlarged view. FIG. 9 illustrates the Federal Standard stitch type 504, after which the thread chain of FIG. 8*a* is formed. In FIGS. 8*a* and 8*b*, the supply length ratio of S1, S2 and S3 per stitch for forming a thread chain is set 1:3:2. When the fabric is at the needle drop point, the above ratio is 1:4:4.

When the supply length ratio of S1, S2 and S3 is 1:3:2 as above, the produced thread chain is extremely expandable. Therefore, the thread chain is stretched out and sewn in within the stitch width W, realizing excellent appearance.

The above ratio 1:3:2 is not the only one for forming a high quality thread chain. It has been known by experiments that a high quality thread chain which can be stretched out into a thin, thread-like shape is formed under the following conditions:

the length of S2+S3 is not more than five times of the length of S1 per stitch; and the smallest length of S1, S2 and S3 is not more than half of the total length of the remaining two threads.

If the length of S2+S3 is more than five times of the length of S1 per stitch, the length of the looper threads is too much for that of the needle thread. Then, the obtained thread chain is not expandable enough to be thin and thread-shaped. If the smallest length of S1, S2 and S3 is more than half of the total length of the remaining two threads, it is difficult to form a thread chain.

In the case of the stitch type 505, the thread supply length ratio for obtaining a high quality thread chain is as shown in Table 1, where the length of the needle thread for the stitch 504 is 1. Also shown is the above ratio when there is the fabric at the needle drop point.

TABLE 1

| Thread | Fabric | Thread chain |
|---|---|---|
| Needle (S1) | 2.5 | 2.5 |
| Upper looper (S2) | 4 | 4 |
| Lower looper (S3) | 2.5 | 2.5 |

In Table 1, S1:S2+S3=2.5:6.5. This means S2+S3 is 2.6 times of S1, which is between twice and five times. As apparent from Table 1, it is not necessary to adopt different thread length ratios for sewing fabric and for forming a thread chain.

The thread length ratio for forming a high quality thread chain in the case of the stitch type 514 has also been obtained by an experiment and is shown in Table 2.

TABLE 2

| | |
|---|---|
| Needle thread (1) | 1 |
| Needle thread (2) | 1 |
| Upper looper thread | 3 |
| Lower looper thread | 2 |

The stitch type 514, distinctly from 504 and 505, requires two needles. In this case, the total length of the upper and lower looper threads should be between twice and five times of the length of the needle thread.

Figure 10:
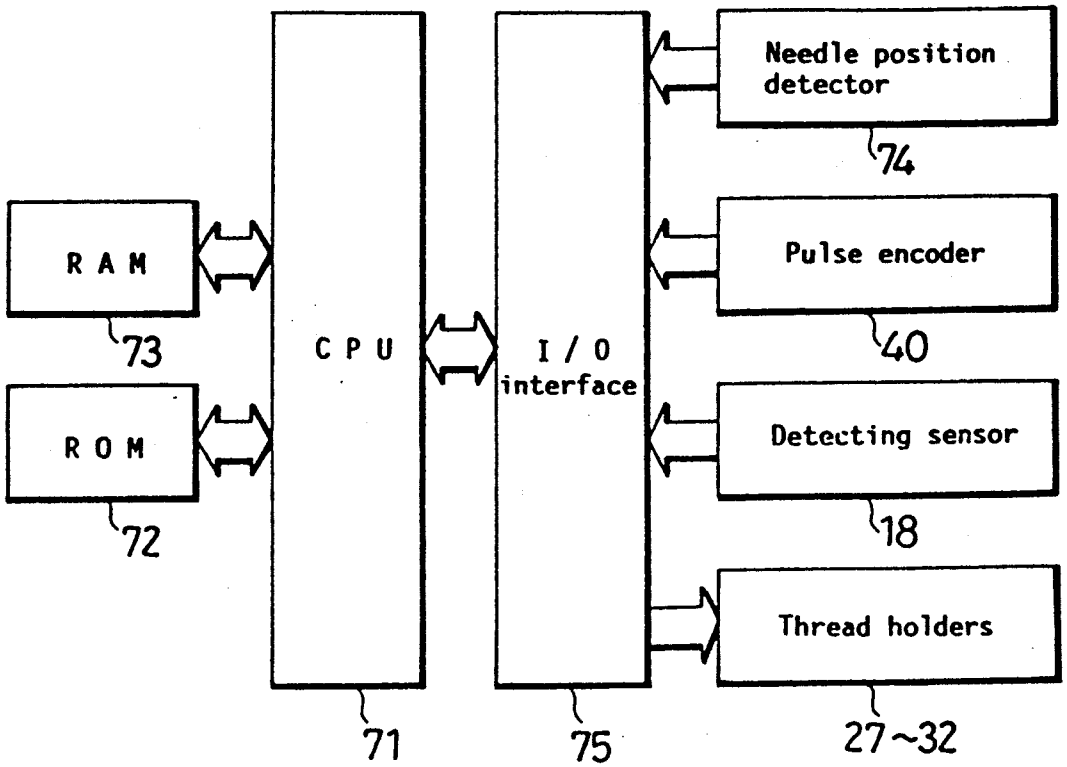
FIG. 10 is a block diagram of control circuits.

FIG. 10 is a block diagram showing the control circuits of the automatic thread supply device 7. 71 refers to a central processing unit (hereinafter referred to as CPU), and 72 and 73 respectively refer to a ROM and a RAM. 74 refers to the conventional needle positioner provided on the main shaft, 75 to an interface connecting the needle position detector 74, the detecting sensor 18, the encoder 40, and the thread holders 27 through 32 to the CPU 71. As shown in FIG. 11, the RAM 73 stores the thread supply length ratio of various kinds of stitches, each for sewing the fabric and for forming a thread chain.

Figure 12:
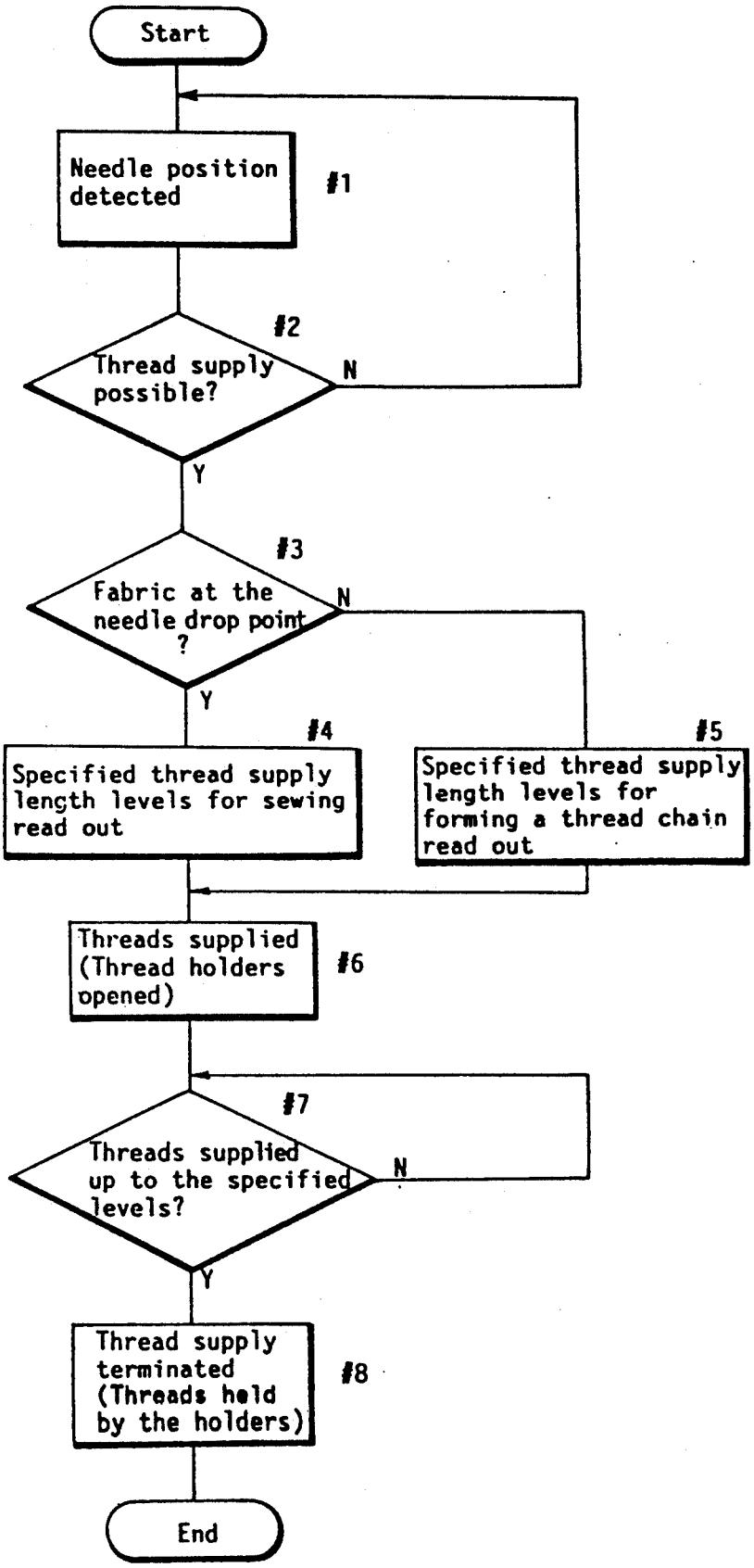
FIG. 12 is a flowchart of the operation of the automatic thread supply device according to this invention.

FIG. 12 is a flowchart showing the operation of the above control circuits. When the needle position detector 74 detects the needle position (#1,), whether the threads should be supplied or not is determined based on the data in FIGS. 5 through 7 (#2). If the CPU 71 judges the threads should be supplied, whether the fabric is at the needle drop point or not is determined from the output of the detecting sensor 18 (#3). If so, specified levels of the thread supply length for sewing the fabric are read out from a specified memory of the RAM 73 (#4). If not, specified levels of the thread supply length for forming a thread chain are read out from another memory of the RAM 73 (#5). After either type of levels are read out, the thread holders 27 through 29 are de-electrified, whereby the threads are supplied by the thread supply rollers and the pressing rollers (#6). At the same time, the detection signal from the encoder 40 is counted, whereby whether the thread supply lengths have reached the predetermined values or not during, the opening periods of the thread holders is determined (#7). When they reach the predetermined values, the solenoids are electrified and the thread supply is terminated (#8). Thereafter, the solenoids are de-electrified and electrified repeatedly for each sewing cycle. The above operation realizes an ideal thread chain.

Although the present invention has been fully described by way of an embodiment with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A thread chain formed by an overlocking sewing machine when there is no fabric at a needle drop point of the overlocking sewing machine, said thread chain comprising:

two looper threads; and at least one needle thread, wherein a total length of the looper threads is not more than five times of a length of said at least one needle thread and wherein a smallest length of any one of the above threads is not more than half of a total length of the remaining threads.

2. A method for making a thread chain, formed by an overlocking machine when there is no fabric at a needle drop point of the overlocking sewing machine, comprising the steps of:

forming a total length of two looper threads not more than five times a length of a needle thread; and forming a smallest length of any one of the above threads not more than half of a total length of the remaining threads.

* * * * *